US005312706A

United States Patent [19]

Springett

[11] Patent Number: 5,312,706

[45] Date of Patent: May 17, 1994

[54] INFRA-RED PHOTOCONDUCTOR BASED ON OCTA-SUBSTITUTED PHTHALOCYANINES

[75] Inventor: Brian E. Springett, Rochester, N.Y.

[73] Assignee: Xerox Corporation, Stamford, Conn.

[21] Appl. No.: 889,881

[22] Filed: May 29, 1992

[51] Int. Cl.[5] ..... G03G 5/04

[52] U.S. Cl. ..... 430/58; 430/57; 430/62; 430/64; 430/78

[58] Field of Search ..... 430/57, 58, 60, 62, 430/78, 64

[56] References Cited

U.S. PATENT DOCUMENTS

| | | | |
|---|---|---|---|
| 3,357,989 | 12/1967 | Byrne et al. . | |
| 3,816,118 | 6/1974 | Byrne . | |
| 4,471,039 | 9/1984 | Borsenberger et al. . | |
| 4,555,463 | 11/1985 | Hor et al. . | |
| 4,587,189 | 5/1986 | Hor et al. . | |
| 4,731,312 | 3/1988 | Kato et al. . | |
| 5,032,480 | 7/1991 | Mashimo et al. | 430/58 |
| 5,039,586 | 8/1991 | Itami et al. | 430/78 |

FOREIGN PATENT DOCUMENTS

| | | |
|---|---|---|
| 0180931 | 5/1986 | European Pat. Off. . |
| 0262761A1 | 4/1988 | European Pat. Off. . |
| 0513370A1 | 5/1992 | European Pat. Off. . |
| 933040529 | 10/1993 | European Pat. Off. . |
| WO88/06175 | 8/1988 | United Kingdom . |

OTHER PUBLICATIONS

Japanese Abstracts, vol. 15, No. 52, (C-803), (1991).

Japanese Abstracts, vol. 9, No. 137, (P-363), (1985).

W. E. Ford et al., "Photoproperties of . . . Absorbance", Photochem and Photobio.; U50; No. 3 pp. 277-282 Jun. 1989.

Cook et al. "Octa-alkoxy phthalocyanine . . . Infrared", J. Chem. Soc. Peskin Trans.; pp. 2453-2458, Jan. 1988.

*Primary Examiner*—John Kight, III

*Assistant Examiner*—John M. Cooney, Jr.

*Attorney, Agent, or Firm*—Oliff & Berridge

[57] ABSTRACT

A photoconductor contains octa-substituted phthalocyanines in a charge generation layer. The photoconductor shows good sensitivity in the infra-red region of the electromagnetic spectrum from about 600 nm to about 900 nm.

33 Claims, 1 Drawing Sheet

INFRA-RED PHOTOCONDUCTOR BASED ON OCTA-SUBSTITUTED PHTHALOCYANINES

BACKGROUND OF THE INVENTION

This invention relates in general to photoconductive elements such as electrophotographic photoreceptors. In particular, this invention relates to photoconductive elements comprising octa-substituted phthalocyanine based pigments which are sensitive to radiation in the infra-red region of the spectrum.

Photoconductive materials have been described as having the ability to generate mobile charge carriers as a result of exposure to actinic radiation or the radiation from solid state sources such as laser diodes and light-emitting diodes in the red or near infra-red portion of the spectrum and to transport them through the bulk of the material. This property has formed the basis for the art of electrophotography, sometimes referred to as "xerography".

Photoconductive elements may comprise a conducting support bearing a layer of a photoconductive material which is insulating in the dark but which becomes conductive upon exposure to actinic or other radiation. A common technique for forming images with such elements is to uniformly electrostatically charge the surface of the element and then imagewise expose it to radiation. In areas where the photoconductive layer is irradiated, mobile charge carriers are generated which migrate to, or away from, the surface of the element and thereby spatially modulate the surface charge. A charge pattern is left behind in non-irradiated areas, referred to as a latent electrostatic image. This latent electrostatic image can then be developed, either on the surface on which it is formed, or on another surface to which it has been transferred, by application of a liquid or dry developer composition which contains finely divided electrostatic marking particles that either are selectively attracted to and deposited in the charged areas or repelled by the charged areas and selectively deposited in the uncharged areas. The pattern of marking particles can be fixed to the surface onto which they are deposited or they can be transferred to another surface and fixed there.

Numerous photoconductor materials have been described as being useful in electrophotography. These include inorganic materials, the best known of which are selenium and zinc oxide, as well as organic materials, monomeric and polymeric, such as arylamines, arylmethanes, azoles, carbazoles, pyrroles, phthalocyanines and the like. For example, U.S. Pat. No. 3,816,118 to Byrne discloses the use of non-substituted metal-free phthalocyanines as photoconductor materials in binder plates; U.S. Pat. No. 3,357,989 to Byrne et al. discloses X-form, metal-free phthalocyanines as photoconductor material in electrophotography; U.S. Pat. No. 4,555,463 to Hor et al. discloses photoresponsive imaging members containing chloroindium phthalocyanine; and U.S. Pat. No. 4,731,312 to Kato et al. discloses photoconductors having a charge generation layer containing indium phthalocyanines.

Electrophotographic elements can comprise a single active layer, containing the photoconductive material, or they can comprise multiple active layers. Elements with multiple active layers (sometimes referred to as multi-active elements) have at least one charge generation layer and at least one charge transport layer. The charge generation layer responds to actinic radiation, or radiation in the red and near infra-red region of the spectrum, by generating mobile charge carriers. The charge transport layer facilitates migration of the charge carriers to or from the surface of the element, in order to dissipate the uniform electrostatic charge and form a latent electrostatic image.

The majority of photoconductors described in the art are sensitive to electromagnetic radiation in the ultraviolet, visible, and near infra-red regions of the electromagnetic spectrum as disclosed in U.S. Pat. No. 4,587,189 to Hor et al. However, as information storage and retrieval technology have evolved, increasing use has been made of light emitting devices which emit radiation principally in the near infra-red region of the electromagnetic spectrum, i.e., from about 600 nm to about 900 nm. Many of the previously known photoconductive materials either do not adequately respond to radiation in this region of the spectrum, i.e., they have little or no sensitivity to such radiation, or if they do respond to such radiation, they suffer from other disadvantages. For example, they may have a very large dark conductivity, which limits their ability to accept and hold electrostatic charge, or they may have poor quantum efficiencies, which prevent them from making effective use of exposing radiation resulting in low electrophotographic sensitivity, or they may require the application of an extremely high electrostatic charge or the use of other extreme conditions in order to exhibit the useful electrophotographic sensitivity. Additionally, they may require cumbersome or costly manufacturing processes.

An example of a photoconductive element reportedly sensitive in the infra-red region appears in U.S. Pat. No. 4,471,039 to Borsenberger et al. which is directed to photoconductive elements comprising $\beta$-phase indium phthalocyanines in the charge generation layer. The phthalocyanines disclosed in Borsenberger et al. may be unsubstituted or have substituents associated with the indium atom or the phthalocyanine rings. Preferred substituents for either the indium atom or phthalocyanine rings are halogen atoms. These photoconductive elements are sensitive to electromagnetic radiation in the infra-red region of the spectrum. Other substituents such as hydroxy, alkoxy, aryloxy, and alkyl may be associated with the indium atom or phthalocyanine rings. However, Borsenberger et al. does not disclose any preferred arrangement for these other substituents for conferring improvements or advantages as in the present invention, nor are they specific as to the nature of any such improvements.

Although there are photoconductive elements which are sensitive to radiation in the infra-red spectrum, there is still a need for photoconductive elements sensitive to the near infra-red region of the electromagnetic spectrum having low dark decay properties, high electrophotographic sensitivity, less sensitivity to property changes induced by environmental shifts in temperature and humidity, and enable improved manufacturability.

SUMMARY OF THE INVENTION

The present invention provides a photoconductive member comprising a charge generation layer (CGL) composed of metal centered, metal-halide centered or 2H centered octa-substituted phthalocyanines, wherein the substituents are para to each other on the exterior rings of the phthalocyanines.

DESCRIPTION OF PREFERRED EMBODIMENTS

Figure 1:
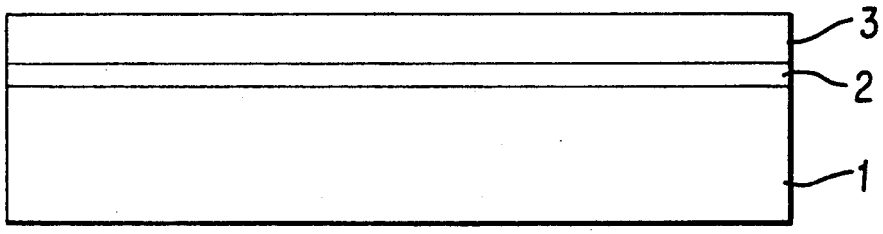
FIG. 1 illustrates a photoconductor element of the present invention.

The photoconductor of the present invention comprises a charge generation layer composed of metal centered, metal-halide centered or 2H centered octa-substituted phthalocyanines wherein the substituents are para to each other on the exterior rings of the phthalocyanines. The substituents are preferably in the 1, 4, 8, 11, 15, 18, 22 and 25 positions. Exemplary octa-substituted phthalocyanines of the present invention may have the general formula:

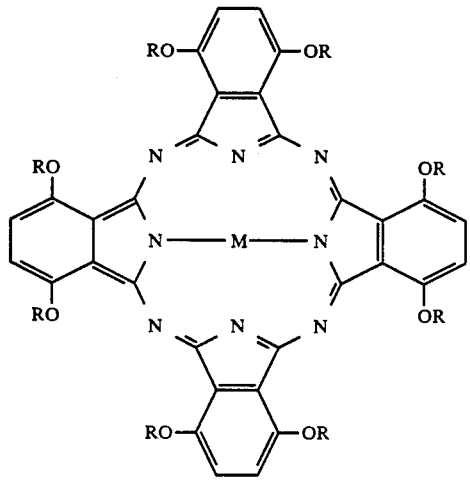

wherein M comprises 2H, a metal or a metal halide; and R comprises straight or branched alkyl groups having from 1 to 10 carbon atoms, or a carboxy group having from 2 to 10 carbon atoms. Suitable metals include, but are not limited to, zinc, copper, magnesium, iron, lead, chromium, nickel, cobalt, vanadium, zirconium and titanium. Suitable metal halides include, but are not limited to, chloroindium, chlorogallium, fluoroindium, fluorogallium, bromoindium and bromogallium.

Photoconductors comprising octa-substituted phthalocyanines of the present invention are sensitive to radiation in the infra-red spectrum. Such photoconductors will preferably discharge about 90% of their charge potential upon exposure to about 30 ergs/cm$^2$ or less of light having wavelengths in the range from about 600 to about 900 nm.

Octa-substitution of phthalocyanines with substituent groups para to each other on the exterior rings of the molecule confers at least three advantages over substitution at other positions. First, the peak in the spectral absorption shifts to longer wavelengths thereby extending spectral response of the pigment, typical shifts being from about 67 nm to about 71 nm. Second, the greater compactness of the molecule more readily propagates charge carriers and excitons through the crystals composed of such molecules, thus improving the ability to extract photogenerated charges from CGLs which use such pigments. Third, these para substituted phthalocyanines have longer lived excited states which permit more exciton migration to surfaces where charge disassociation can occur.

Preferred octa-substituted phthalocyanines employed within the scope of this invention include 1, 4, 8, 11, 15, 18, 22, 25-octa-n-butoxyphthalocyanine; 1, 4, 8, 11, 15, 18, 22, 25-octa-n-methoxyphthalocyanine, 1, 4, 8, 11, 15, 18, 22, 25-octa-n-ethoxyphthalocyanine and 1, 4, 8, 11, 15, 18, 22, 25-octa-n-propoxyphthalocyanine and their metal-centered derivatives, wherein the metal comprises zinc or copper. Other suitable metal octa-substituted phthalocyanines include, but are not limited to, metal oxide phthalocyanines such as vanadyl, titanyl or zirconyl phthalocyanines.

Synthesis of phthalocyanine compounds is well known in the art. "Phthalocyanine Compounds" by F. H. Moser and A. L. Thomas, published by Reinhold Company (1963) includes a detailed description of phthalocyanines and their synthesis. Other references disclosing the synthesis of phthalocyanines include "Carboxylated Zinc-Phthalocyanine, Influence of Dimerization on the Spectroscopic Properties. An Absorption Emission, and Thermal Lensing Study" by R. Martin Negri et al. published by Pergamon Press plc (1991); "Synthesis of Positively Charged Phthalocyanines and Their Activity in the Photodynamic Therapy of Cancer Cells" by D. Wöhrle et al. published by Pergamon Press plc (1990); and "Octa-alkoxy Phthalocyanine and Naphthalocyanine Derivatives: Dyes with Q-Band Absorption in the Far Red or Near Infrared" by Michael J. Cook et al. published by the Journal of the Chemical Society (1988). The entire disclosures of these references are herein incorporated by reference.

Octa-substituted phthalocyanines are soluble in a variety of solvents and thus are capable of being made in a highly purified state (a property found to be highly useful for preparation of successful photoconductors). Solvents suitable for dissolving octa-substituted phthalocyanines include, but are not limited to, benzene, dichloromethane, methylene chloride, carbon tetrachloride, ether, acetone, ethyl alcohol, methyl alcohol and diethyl ether.

Octa-substituted phthalocyanines can be dissolved in a solvent and mixed with a binder material to form a pigment-binder composition. This composition can then be applied to a substrate to form a charge generation layer of a photoconductor. Alternatively, the octa-substituted phthalocyanines can be applied to a substrate without a binder material.

In addition to being incorporated into a pigment-binder charge photogenerating layer as the sole photogenerating material, the octa-substituted phthalocyanines of the invention may be incorporated together with unsubstituted metal or 2H phthalocyanines in order to modify one or more of the following properties: photosensitivity, spectral response, dark decay, or temperature and humidity sensitivity.

Examples of suitable phthalocyanines which can be combined with the octa-substituted phthalocyanines include, but are not limited to, 2H(metal-free)-phthalocyanine, titanium oxy-phthalocyanine, vanadium oxy-phthalocyanine, aluminum phthalocyanine, aluminum polychlorophthalocyanine, barium phthalocyanine, beryllium phthalocyanine, cadmium phthalocyanine, calcium phthalocyanine, cerium phthalocyanine, chromium phthalocyanine, cobalt phthalocyanine, cobalt chlorophthalocyanine, copper bromophthalocyanine, copper 4-chlorophthalocyanine, copper phthalocyanine, and the like.

When octa-substituted phthalocyanines are combined with another phthalocyanine, the ratio of octa-substituted phthalocyanine: unsubstituted metal or 2-H phthalocyanine ranges from about 1:10 to about 1:1 by volume.

Charge transporting molecules can be introduced into the charge generating layer during the manufacturing process by the processes of diffusion. It is also entirely feasible to deliberately introduce charge transporting molecules into the pigment-binder polymer dispersion. The reason for doing this is to facilitate charge motion within and extraction from the charge generation layer. In such cases the concentration of charge molecules should be in the range from 5-50% by volume, and preferably from 5-20%.

If a binder material is employed, the combination of photosensitive pigment, binder polymer and solvent is preferably formed into a uniform dispersion. Any suitable polymer or copolymer may be used in combination with the octa-substituted phthalocyanines to prepare a charge generation layer. Typical insulating film forming binders include thermoplastic and thermoset polymers such as polyvinyl chloride, polyvinyl alcohol, polyvinyl acetates, polystyrene, polystyrene-polybutadiene copolymer, polymethacrylates, polyacrylates, polyacrylonitriles, silicon resins, chlorinated rubber, epoxy resins including halogenated epoxy and phenoxy resins, phenolics, epoxy phenolic copolymers, epoxy ureaformaldehyde copolymers, epoxy melamine formaldehyde, polycarbonates, polyurethanes, polyamides, saturated polyesters, unsaturated polyesters cross-linked with vinyl monomers and epoxy esters, vinyl epoxy resins and copolymers and mixtures thereof. In addition to the above noted materials, any other suitable binder may be used.

Preferred binder materials are those which readily dissolve in common solvents for ease of manufacture, which have dielectric constants approaching that of the pigment (i.e. $>3$) for ease of charge transfer from the pigment, and in which it is easy to achieve solid solutions of the charge transport molecule used in the charge transport layer, again for improvements in charge transfer and transport within the CGL. As a consequence of these conditions, preferred binder polymers are polycarbonates, polyvinyl butyral, and polymethacrylates.

Octa-substituted phthalocyanine pigments can be incorporated in dissolved or melted binders by any suitable means which is practiced in the art, such as strong shear agitation, preferably with simultaneous grinding. These methods include ball milling, roller milling, sand milling, ultrasonic agitation, high speed blending and any desirable combination of these methods. In addition to adding the phthalocyanine pigment to the dissolved or melted binder material it can also be added and blended in a dried or slurried form of powdered binder material before it is heated or dissolved to make it film forming. Any suitable range of pigment-resin ratio may be used. On a phthalocyanine pigment-dried binder weight basis, a usable range extends from about 4:1 to about 1:100 while a more preferred range extends from about 2:1 to about 1:4. Optimum results are obtained when ratios from about 1:1 to about 2:3 are used and accordingly this range is most preferred. Other photoconductive pigments known in the art can also be added to the system when phthalocyanine is used in ratios given above.

The pigment-binder solvent dispersion (or the pigment-bindermelt) can be applied to conductive substrates by any of the well known painting or coating methods including spray, flow coating, knife coating, electrocoating, Mayer bar drawdown, dip coating, reverse roll coating, etc. If the pigment is employed without a binder, the pigment can be applied to conductive substrates by vacuum deposition or spin coating. "Deposition of Ordered Phthalocyanine Films by Spin Coating" by Susan M. Critchley et al. published by Journal of Material Chemistry (1992) discloses the procedure for spin coating substrates with phthalocyanine pigments and is herein incorporated by reference. The setting, drying and/or curing steps for these films are generally similar to those recommended for films of particular binders as is well known in the art. The thickness of the phthalocyanine films may be varied from about 0.1 to about 100 microns depending on the required individual needs and the specific material and coating design. Preferred ranges are from about 0.3 to about 2.0 microns when used in a multi-layer device.

The substrate may have any of a number of different configurations, such as, for example, a sheet, a scroll, an endless flexible belt, rigid cylindrical tube and the like. Preferably the substrate is in the form of an endless flexible belt. The substrate can comprise electrically non-conducting materials. These materials can include various resins known for this purpose, including polyesters, polycarbonates, polyamides, polyurethanes, and the like. Such substrates preferably comprise a commercially available biaxially oriented polyester known as Mylar, available from E.I. du Pont de Nemours & Company, Wilmington, Del., U.S.A. Melinex also can be used and is available from ICI Americas Inc. Other materials of which the substrate can be comprised include polymeric materials such as polyvinyl fluoride, available as Tedlar from E.I. du Pont de Nemours & Co. and polyamides, available as Kapton from E.I. du Pont de Nemours & Co.

When a conductive substrate is employed it may be coated with any suitable conductor material. For example, the conductive material may include metal flakes, powders or fibers, such as aluminum, titanium, nickel, chromium, brass, gold, stainless steel, carbon black, graphite, or the like, in a binder resin including metal oxides, sulfides, silicides, quaternary ammonium salt compositions, conductive polymers such as polyacetylene or their pyrolysis and molecular doped products, charge transfer complexes, polyphenolsilane and molecular doped products from polyphenolsilane. The flexible substrate may be made from electroformed nickel or welded stainless steel. In such cases, the substrate thickness ranges from 50 to 200 microns.

A charge transport layer can be coated or vacuum deposited on the charge generation layer. The charge transport layer can comprise any material, organic or inorganic, which is capable of transporting charge carriers generated in the charge generation layer. Most charge transport materials preferentially accept and transport either positive charges (holes) or negative charges (electrons) although there are materials known which will transport both positive and negative charges. Transport materials which exhibit a preference for conduction of positive charge carriers are referred to as p-type transport materials whereas those which exhibit a preference for conduction of negative charges are referred as n-type transport materials.

Various p-type organic charge transport materials may be used in charge transport layers of the present invention. Any of a variety of organic photoconductive materials which are capable of transporting positive charge carriers may be employed. Representative p-type organic photoconductive materials include:

1. Carbazole materials including carbazole, N-ethyl carbazole, N-isopropyl carbazole, N-phenyl carbazole, halogenated carbazoles, various polymeric carbazole materials such as poly(vinyl carbazole), halogenated poly(vinyl carbazole) and the like.

2. Arylamine containing materials include monarylamines, diarylamines, triarylamines, as well as polymeric arylamines. Other suitable arylamines and polyarylalkane materials can be found in, e.g., U.S. Pat. No. 4,471,039 to Borsenberger et al., the entire disclosure of which is hereby incorporated herein by reference.

Representative of n-type charge-transport materials are strong acids such as organic, including metalo-organic, materials containing one or more aromatic groups including aromatically unsaturated heterocyclic materials bearing an electron withdrawing substituent. These materials are considered useful because of their characteristic electron accepting capability. Typical electron withdrawing substituents include cyano and nitro groups; sulfonate groups; halogens such as chlorine, bromine and iodine; ketone groups; ester groups; acid anhydride groups; and other acid groups such as carboxyl and quinone groups. A partial listing of such representative n-type aromatic acid materials having electron withdrawing substituents include phthalic anhydride, tetrachlorophthallic anhydride, benzil, metallic anhydride, S-tricyanobenzene, picryl chloride, 2,4-dinitrochlorobenzene, 2,4-dinitrobromobenzene, 4-nitrobiphenyl, 4,4-dinitrobiphenyl, 2,4,6-trinitroanisole, trichlorotrinitrobenzene, trinitro-o-toluene, 4,6-dichloro-1,3-dinitrobenzene, 4,6-dibromo-1,3-dinitrobenzene, p-dinitrobenzene, chloranil, bromanil, 2,4,7-trinitro-9-fluorenone, 2,4,5,7-tetranitroflourenone, trinitroanthracene, dinitroacridiene, tetracyanopyrene, dinitroanthraquinone, and mixtures thereof.

Other useful n-type charge transport materials which may be employed in the present invention are conventional n-type organic photoconductors, for example, complexes of 2,4,6-trinitro-9-fluorenone and poly(vinyl carbazole).

A single charge transport layer can be employed or more than one can be employed. Where a single charge transport layer is employed, it can be either a p-type or an n-type material. The charge transport layer ranges from about 1 micron to about 100 microns thick.

A preferred configuration of layers has the charge generation layer 2 between a conducting support 1 and a single charge transport layer 3 as illustrated in FIG. 1. Since there are a multiplicity of suitable charge transport materials, this arrangement provides a great deal of flexibility and permits physical and surface characteristics of the element to be controlled by the nature of the charge transport layer selected.

The charge generation layer and the charge transport layer can also contain other materials such as leveling agents, surfactants, plasticizers and the like to enhance or improve various physical properties of the layers. Phthalocyanine concentrations in the charge generation-binder layer can range from about 20% by volume to about 90% by volume. Preferred ranges are from about 35% by volume to about 75% by volume.

In addition, various materials to modify the electrophotographic response of the photoconductor can be incorporated in the charge transport layer. For example, various contrast control materials such as certain hole-trapping agents and certain easily oxidized dyes known to those of skill in the art can be incorporated in the charge transport layer.

Optional overcoat layers can be used in the photoconductors of the present invention. For example, to improve surface hardness and resistance to abrasion, the surface of the photoconductor can be coated with one or more electrically insulating, organic polymer coatings or electrically insulating inorganic coatings. These coatings are well known to those of skill in the art.

In an alternative embodiment of the present invention, a hole blocking layer can be applied to the substrate followed by applying thereto a charge generation layer containing octa-substituted phthalocyanines. A hole blocking layer may include any suitable material capable of forming a barrier to prevent hole injection from the conductive layer to the photoconductive layer. For example, the blocking layer is preferably a metal oxide or nitride. Aluminum oxide and other oxides are suitable and may provide better surfaces for charge generation layer adhesion. Other oxides which can be used to form the blocking layer include, for example, oxides of silicone, oxides of titanium, oxides of zirconium and the like.

The blocking layer of this invention may be formed by any one of a number of methods practiced in the art. According to one method, a metal oxide layer is formed by exposing a substrate such that the metal on the substrate forms a metal oxide on the outer surface upon exposure to oxygen. Exposure to oxygen can be effected by introducing a partial pressure of oxygen into a reduced-pressure environment.

Alternatively, the blocking layer of the present invention can be evaporated from, for example, a metal oxide, onto a substrate by electron beam evaporation or sputtering. Sputtering may involve direct sputtering of oxide or nitride, or reactive sputtering of a metal in an oxygen or nitrogen partial pressure resulting in deposition of the compound. Alternatively, reactive sputtering can be combined with direct sputtering of the metal so that first the metal substrate layer is deposited followed by the oxide or nitride of the metal.

In some cases, an adhesive layer is applied between the charge blocking layer and the charge generation layer for greater adhesion. The adhesive layer can be applied by vacuum deposition or by solvent coating. If an adhesive layer is utilized, it preferably has a thickness between about 0.001 micrometers to about 0.2 micrometers and preferably is applied while in a reduced pressure environment. Adhesives include, for example, film-forming polymers such as polyester (e.g., du Pont 49,000 resin available from E.I. du Pont de Nemours & Co.; Vitel PE-100 and Vitel PE-200 resins available from Goodyear Rubber and Tire Co.), polyvinylbutyryl, polyvinylpyrrolidone, polyurethane, polymethylmethacrylate, 2-vinyl pyridine, 4-vinyl pyridine, polyvinyl alcohol, polyvinyl chloride and the like.

Photoconductors comprising octa-substituted phthalocyanines have low dark decay, good cycle stability and yield properties attributed to thin charge generation layers. Photoconductors comprising octa-substituted phthalocyanines of the present invention are equivalently economical to manufacture as current photoreceptors. The photoconductors of the present invention also are less sensitive to environmental changes such as temperature or humidity shifts than current photoreceptors.

The following examples are intended to more clearly illustrate the present invention and are not intended to limit the scope of the invention. Other embodiments and modifications can be made by those of skill of the art without departing from the spirit and scope of the invention.

EXAMPLE 1

A photoconductor is prepared by providing an aluminized Mylar substrate in a thickness of about 3 mils with a du Pont 49,000 polyester adhesive layer thereon in a thickness of 0.01 micrometers, and coating thereover in a vacuum coater a charge generating pigment zinc 1, 4, 8, 11, 15, 18, 22, 25-octa-n-butoxy phthalocyanine with a final thickness of 0.10 micrometer.

Thereafter, the above photogenerating layer is overcoated with an amine charge transport layer which is prepared as follows:

A transport layer composed of 65% by weight Merlon, a polycarbonate resin readily available, is mixed with 35% by weight N,N'-diphenyl-N,N'-bis(3-methylphenyl)-1,1'-biphenyl-4,4'-diamine. This solution is mixed to 7% by weight in methylene chloride. All of these components are placed in an amber bottle and dissolved. The mixture is coated to provide a layer with a dry thickness of 15 micrometers on top of the above photogenerating layer, using a multiple clearance film applicator (10 mils wet gap thickness). The resulting member is then dried in a forced air oven at 135° C. for twenty minutes.

The photosensitivity of this member is then determined by electrostatically charging the surface thereof under a corona discharge source until the surface potential, as measured by a capacitively coupled probe attached to an electrometer, attains an initial dark value $V_O$ of −800 V, the initial surface potential. The front surface of the charged element is then exposed to light from a filtered Xenon lamp, XBO 75 watt source, allowing light in the wavelength range of about 600 to about 900 nm to reach the surface. The photosensitivity is about 90% discharge by about 30 ergs/cm$^2$ of energy. The higher the photosensitivity, the smaller the exposure energy required to discharge 50% of the surface potential. The photosensitivity results also indicate that the photoconductor has low dark decay and excellent cycle stability.

EXAMPLE 2

Zinc 1, 4, 8, 11, 15, 18, 22, 25-octa-n-butoxy phthalocyanine ($ZnPc(OBu)_8$) may be prepared by any method well known to those of skill in the art. A sufficient mass of $ZnPc(OBu)_8$ is placed in an aluminum crucible disposed in a vacuum evaporation coater and the temperature of the crucible is maintained at 400° C. during the vacuum vapor deposition to form a thin film (having a thickness of about 0.02 to about 0.04 micrometers) on a glass substrate. The light absorption spectra of the resulting thin film with respect to light having wavelengths of about 600 to about 900 nm is measured with an automatic recording spectrophotometer, and the results disclose light absorption at a maximum point of about 740 nm. This value represents a shift of about 70 nm compared to the unsubstituted ZnPc peak absorption at 670 nm (Reference: C.C. Leynoff et al., Photochemistry and Photobiology, 49,279 (1989), Perquinn Press.) The film also has a low dark decay and excellent cycle stability.

EXAMPLE 3

Zinc 1, 4, 8, 11, 15, 18, 22, 25-octa-n-pentoxyphthalocyanine is substituted for the butoxy zinc phthalocyanine compound in Examples 1 and 2 and shows similar results and advantages.

EXAMPLE 4

Copper 1, 4, 8, 11, 15, 18, 22, 25-octa-n-butoxy phthalocyanine is substituted for butoxy zinc phthalocyanine compound in Examples 1 and 2 and shows similar results and advantages.

EXAMPLE 5

Copper or Zinc 1, 4, 8, 11, 15, 18, 22, 25-octa-n-butoxy phthalocyanine or the Copper or Zinc 1, 4, 8, 11, 15, 18, 22, 25-octa-n-pentoxy phthalocyanine is dissolved in toluene (or tetrahydrofuran [THF] or toluene-THF mixtures) and the resulting solution coated onto the substrate of Example 1 by gravure, slot or slide coating. The solvent evaporates rapidly leaving a quasi-crystalline film of about 0.05–0.10 micron thickness. This film may be overcoated with the film as described in Example 1. The photosensitivity of the photoconductor is about 90% discharged by about 30 ergs/cm$^2$.

What is claimed is:

1. A photoconductor comprising a charge generation layer, wherein the charge generation layer comprises a metal centered octa-substituted phthalocyanine, wherein substituents on exterior rings of the phthalocyanine comprise alkoxy groups and where said alkoxy groups are para to each other.

2. A photoconductor of claim 1, wherein the octa-substituted phthalocyanine has the formula:

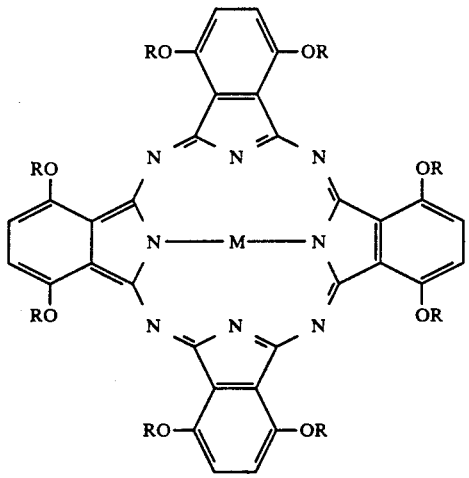

wherein M is at least one member selected from the group consisting of zinc, copper, magnesium, iron, lead, manganese, chromium, nickel, cobalt, vanadium, zirconium, titanium, chloroindium, chlorogallium, bromoindium, and bromogallium; R is at least one member selected from the group consisting of a straight chain alkyl group having from 1 to 10 carbon atoms, a branched alkyl group having from 1 to 10 carbon atoms and a carboxyl group having from 2 to 10 carbon atoms.

3. The photoconductor of claim 1, wherein the charge generation layer further comprises a binder.

4. The photoconductor of claim 3, wherein a ratio of pigment:binder ranges from about 4:1 to about 1:100 by weight of the charge generation layer.

5. The photoconductor of claim 3, wherein the ratio of pigment:binder ranges from about 1:4 to about 2:1 by weight of the charge generation layer.

6. The photoconductor of claim 3, wherein the ratio of pigment:binder ranges from about 1:1 to about 2:3 by weight of the charge generation layer.

7. The photoconductor of claim 1, wherein the octa-substituted phthalocyanine is at least one member selected from the group consisting of 1, 4, 8, 11, 15, 18, 22, 25-octa-n-butoxyphthalocyanine; 1, 4, 8, 11, 15, 18, 22, 25-octa-n-methoxyphthalocyanine; 1, 4, 8, 11, 15, 18, 22, 25-octa-n-ethoxyphthalocyanine; 1, 4, 8, 11, 15, 18, 22, 25-octa-n-pentoxy phthalocyanine and 1, 4, 8, 11, 15, 18, 22, 25-octa-n-propoxyphthalocyanine.

8. The photoconductor of claim 2, wherein M is at least one member selected from the group consisting of zinc and copper.

9. The photoconductor of claim 1, further comprising a substrate.

10. The photoconductor of claim 9, further comprising a charge blocking layer and an adhesive layer between the charge blocking layer and the charge generation layer.

11. The photoconductor of claim 1, wherein the charge generation layer contains from about 20% by volume to about 90% by volume of the octa-substituted phthalocyanine.

12. The photoconductor of claim 1, wherein the charge generation layer contains from about 35% by volume to about 75% by volume of the octa-substituted phthalocyanine.

13. The photoconductor of claim 1, wherein the photoconductor is sensitive to light at wavelengths ranging from about 600 to about 900 nm.

14. A photoconductor comprising a substrate, a charge blocking layer, a charge generation layer and a charge transport layer, wherein the charge generation layer comprises a metal center octa-substituted phthalocyanine wherein substituents on exterior rings of the phthalocyanine comprise alkoxy groups and wherein said alkoxy groups are para to each other 15. The photoconductor of claim 1, further comprising at least one unsubstituted phthalocyanine selected from the group consisting of 2H(metal-free)-phthalocyanine, titanium oxy-phthalocyanine, vanadium oxy-phthalocyanine, aluminum phthalocyanine, aluminum polycholorphthalocyanine, barium phthalocyanine, beryllium phthalocyanine, cadmium phthalocyanine, calcium phthalocyanine, cerium phthalocyanine, chromium phthalocyanine, cobalt phthalocyanine, cobalt chlorophthalocyanine, copper bromophthalocyanine, copper 4-chlorophthalocyanine and copper phthalocyanine.

16. The photoconductor of claim 15, wherein the ratio of octa-substituted phthalocyanine: unsubstituted phthalocyanine ranges from about 1:10 to about 1:1.

17. A method for preparing a photoconductor comprising:

(a) applying a charge generation layer to a substrate; and (b) applying a charge transport layer to the charge generation layer;

wherein the charge generation layer comprises a metal centered octa-substituted phthalocyanine, wherein substituents on exterior rings of the phthalocyanine comprise alkoxy groups and wherein said alkoxy groups are para to each other.

18. The method of claim 17, wherein the octa-substituted phthalocyanine has the following formula:

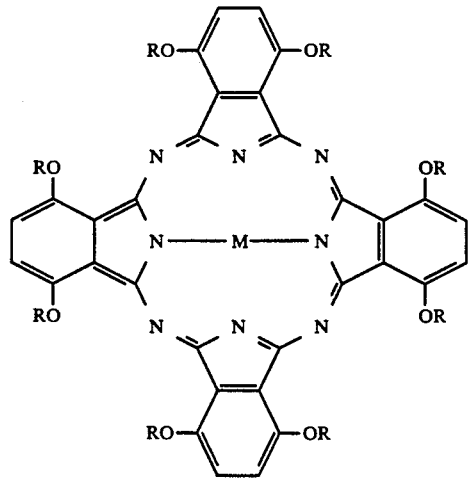

wherein M comprises a metal; and R is at least one member selected from the group consisting of a straight chain alkyl group having from 1 to 10 carbon atoms, a branched alkyl group having from 1 to 10 carbon atoms and a carboxyl group having from 2 to 10 carbon atoms.

19. The method of claim 17, wherein the charge generation layer is applied to the substrate by web-coating, spray coating, dip coating, vacuum deposition or spin coating.

20. The method of claim 17, wherein the charge generation layer comprises a binder.

21. The method of claim 20, wherein the ratio of pigment-binder is about 4:1 to about 1:100.

22. The method of claim 20, wherein the ratio of pigment-binder is about 1:4 to about 2:1.

23. The method of claim 20, wherein the ratio of pigment-binder is about 1:1 to about 2:3.

24. The method of claim 17, further comprising drying the charge generation layer on the substrate.

25. The method of claim 17, further comprising applying a charge blocking layer onto the substrate before applying the charge generation layer.

26. The method of claim 25, wherein an adhesive layer is applied onto the charge blocking layer before applying the charge generation layer.

27. The method of claim 17, wherein the octa-substituted phthalocyanine is 1, 4, 8, 11, 15, 18, 22, 25-octa-n-butoxy phthalocyanine, 1, 4, 8, 11, 15, 18, 22, 25-octa-n-methoxyphthalocyanine, 1, 4, 8, 11, 15, 18, 22, 25-octa-n-ethoxyphthalocyanine or 1, 4, 8, 11, 15, 18, 22, 25-octa-n-propoxyphthalocyanine.

28. The method of claim 18, wherein M comprises zinc or copper.

29. The method of claim 17, wherein the charge generation layer contains from about 20% by volume to about 90% by volume of the octa-substituted phthalocyanine.

30. The method of claim 29, wherein the charge generation layer contains from about 35% by volume to about 75% by volume of the octa-substituted phthalocyanine.

31. The method of claim 17, further comprising the step of adding an unsubstituted phthalocyanine to the charge generation layer.

32. The method of claim 31, wherein the unsubstituted phthalocyanine comprises at least one member selected from the group consisting of 2H(metal-free)-phthalocyanine, titanium oxy-phthalocyanine, vanadium oxy-phthalocyanine, aluminum phthalocyanine, aluminum polychlorophthalocyanine, barium phthalocyanine, beryllium phthalocyanine, cadmium phthalocyanine, calcium phthalocyanine, cerium phthalocyanine, chromium phthalocyanine, cobalt phthalocyanine, cobalt chlorophthalocyanine, copper bromophthalocyanine, copper 4-chlorophthalocyanine and copper phthalocyanine.

33. The method of claim 32, wherein the ratio of octa-substituted phthalocyanine: unsubstituted phthalocyanine ranges from about 1:10 to about 1:1.

* * * * *